US007246997B2

(12) United States Patent
Liu et al.

(10) Patent No.: US 7,246,997 B2
(45) Date of Patent: Jul. 24, 2007

(54) INTEGRATED HIGH EFFICIENCY BLOWER APPARATUS FOR HVAC SYSTEMS

(75) Inventors: Xiaoyue Liu, Clifton Park, NY (US); Herman Weigman, Niskayuna, NY (US); Shixiao Wang, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 469 days.

(21) Appl. No.: 10/604,671

(22) Filed: Aug. 8, 2003

(65) Prior Publication Data

US 2005/0042107 A1 Feb. 24, 2005

(51) Int. Cl.
*F04D 29/36* (2006.01)

(52) U.S. Cl. ..... 415/204; 415/206; 415/208.1; 416/185

(58) Field of Classification Search ..... 415/175–176, 415/178, 204, 206, 208.1, 101–102, 211.1, 415/228; 416/185, 186 R, 187–188, 223 B, 416/238, 242; 62/180, 186
See application file for complete search history.

(56) References Cited

U.S. PATENT DOCUMENTS

| | | | | |
|---|---|---|---|---|
| 1,875,881 | A * | 9/1932 | Clark | 415/206 |
| 3,145,912 | A * | 8/1964 | Weis | 415/204 |
| 3,775,029 | A * | 11/1973 | Ranz | 415/206 |
| 3,811,790 | A * | 5/1974 | Mikulina et al. | 415/206 |
| 4,063,060 | A * | 12/1977 | Litch, III | 219/93 |
| 4,647,271 | A * | 3/1987 | Nagai et al. | 416/186 R |
| 4,806,833 | A | 2/1989 | Young | |
| 5,088,886 | A * | 2/1992 | Hopkins | 415/206 |
| 5,197,667 | A | 3/1993 | Bowsky et al. | |
| 5,738,167 | A | 4/1998 | Asbjornson et al. | |
| 6,210,109 | B1 * | 4/2001 | Will et al. | 415/204 |
| 6,423,118 | B1 | 7/2002 | Becerra | |
| 6,456,023 | B1 | 9/2002 | Becerra | |
| 6,508,627 | B2 | 1/2003 | Gerken et al. | |
| 2003/0042860 | A1 | 3/2003 | Sulfstede | |

FOREIGN PATENT DOCUMENTS

| | | | | |
|---|---|---|---|---|
| DE | 4023724 | A1 * | 4/1991 | 415/208.1 |
| GB | 941343 | A * | 11/1963 | 416/186 R |
| JP | 55-134797 | A * | 10/1980 | 416/185 |
| JP | 59-93997 | A * | 5/1984 | 415/206 |
| SU | 1262122 | A1 * | 10/1986 | 415/206 |

* cited by examiner

*Primary Examiner*—Igor Kershteyn
(74) *Attorney, Agent, or Firm*—Fletcher Yoder

(57) ABSTRACT

An integrated centrifugal blower wheel for a heating, ventilation and air conditioning (HVAC) blower unit includes a first blade support, a second blade support, and a plurality of S-shaped blades disposed between the first and second blade supports, wherein each of the S-shaped blades has a trailing edge bent in a forward direction with respect to a defined direction of rotation of the wheel.

19 Claims, 9 Drawing Sheets

INTEGRATED HIGH EFFICIENCY BLOWER APPARATUS FOR HVAC SYSTEMS

STATEMENT OF GOVERNMENT INTEREST

The Government may have certain rights in the present application, pursuant to (Department of Energy) Contract Number DE-FC26-00NT40993.

BACKGROUND OF THE INVENTION

The present disclosure relates generally to heating, ventilation and air conditioning (HVAC) systems and, more particularly, to an integrated, high efficiency blower apparatus for HVAC systems.

A majority of residential (and many commercial) HVAC units employ forwardly curved (FC) centrifugal blowers in order to draw air into the HVAC units from the spaces to be heated or cooled, and to simultaneously push heated or cooled air from the units back into the spaces to be heated or cooled. The FC centrifugal blowers used in these types of HVAC units (i.e., where duty is comparatively light and it is desirable to keep the initial cost of the HVAC unit low) are advantageous from the standpoint of requiring a relatively smaller blower housing and typically operating at lower rotational speeds. However, the static efficiency of an FC blower is fairly low because of the inherent aerodynamic characteristics of FC blades. One way to improve upon the blower efficiency of an HVAC unit is to utilize an electronically commutated motor (ECM) in lieu of a more traditional single-speed induction motor, as is described more fully in U.S. Pat. No. 4,806,833 to Young.

On the other hand, backwardly curved (BC) or inclined blowers have higher static efficiency and total efficiency at higher operating speeds and pressures. However, the speed vs. torque curves of a BC blower are overlapped with one other, and thus cannot be used for the same flow control as FC blades. As such, it is challenging to combine both flow controllability and high efficiency performance in a HVAC blower system. In addition, residential HVAC systems have limited packaging space for blower assemblies. Thus, the overall efficiency of a BC blower in combination with an ECM may still be compromised by poor housing and fan design, notwithstanding the improvement in efficiency over a unit with a forwardly curved blower.

Accordingly, it is desirable to be able to reduce energy consumption of an HVAC system by improving airflow controllability, in view of the torque-speed characteristics of backwardly curved blowers.

BRIEF DESCRIPTION OF THE INVENTION

The above discussed and other drawbacks and deficiencies of the prior art are overcome or alleviated by a centrifugal blower wheel for a heating, ventilation and air conditioning (HVAC) blower unit. In an exemplary embodiment, the blower wheel includes a first blade support, a second blade support, and a plurality of S-shaped blades disposed between the first and second blade supports, wherein each of the S-shaped blades has a trailing edge bent in a forward direction with respect to a defined direction of rotation of the wheel.

In another aspect, an integrated heating, ventilation and air conditioning (HVAC) blower apparatus includes a centrifugal blower wheel disposed within a housing, and an electronically commutated motor (ECM) in operative communication with the centrifugal blower wheel, the ECM extending at least partially through a first inlet cone disposed in a first side of the housing. The centrifugal blower wheel further includes a first blade support, a second blade support, and a plurality of S-shaped blades disposed between the first and second blade supports, wherein each of the S-shaped blades has a trailing edge bent in a forward direction with respect to a defined direction of rotation of the wheel.

In still another aspect, a heating, ventilation and air conditioning (HVAC) system for heating/cooling a space includes a system controller, at least one of heating and cooling source, an integrated blower apparatus in communication with the system controller, and an airflow path for circulating air through the space. The integrated blower apparatus further includes a centrifugal blower wheel disposed within a housing, the centrifugal blower wheel further including a first blade support, a second blade support, and a plurality of S-shaped blades disposed between the first and second blade supports. Each of the S-shaped blades has a trailing edge bent in a forward direction with respect to a defined direction of rotation of the wheel. An electronically commutated motor (ECM) is in operative communication with the centrifugal blower wheel, the ECM extending at least partially through a first inlet cone disposed in a first side of the housing.

BRIEF DESCRIPTION OF DRAWINGS

Referring to the exemplary drawings wherein like elements are numbered alike in the several Figures.

DETAILED DESCRIPTION OF THE INVENTION

Disclosed herein is an integrated, high efficiency blower apparatus for HVAC systems including, among other aspects, a blower wheel having "S" shaped fan blades/impellers. T he S-shaped blades (based on generally backward inclined blade principles, but also having the trailing edges thereof forwardly disposed), along with a specially designed housing and inlet cone, results in higher static efficiencies and air flow control via torque and speed information than conventionally designed centrifugal HVAC blowers. More specifically, the present invention embodiments have addressed the airflow controllability issue by bending the blade's trailing edge forward so as to generate unique torque-speed curves vs. static pressure and airflow. In addition, the blower assembly also features an integrated ECM for further efficiency improvements, as described in greater detail hereinafter.

Figure 1:
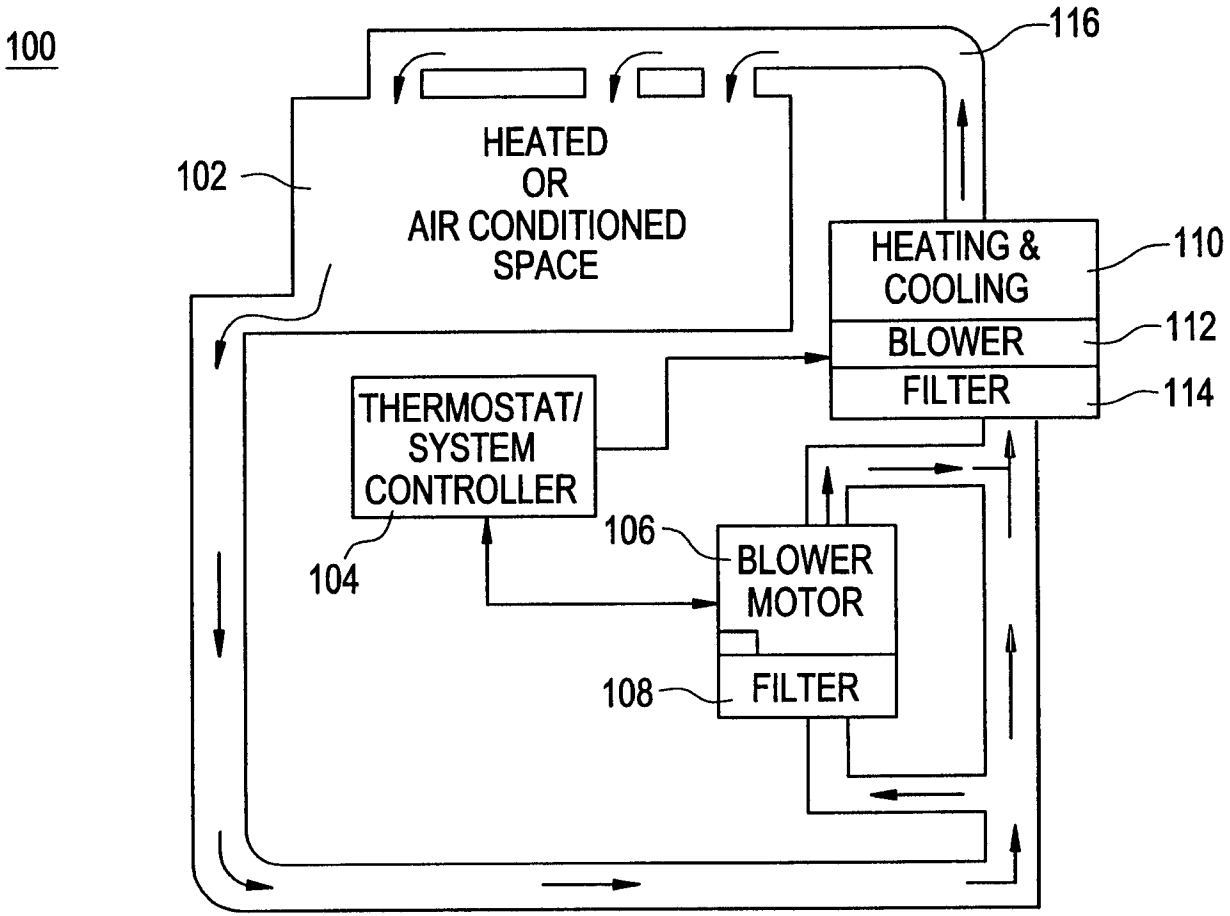
FIG. 1 is a schematic diagram of an exemplary heating, ventilation and air conditioning (HVAC) system, suitable for use in accordance with an embodiment of the invention.

Referring initially to FIG. 1, there is shown a schematic diagram of an exemplary heating, ventilation and air conditioning (HVAC) system 100 configured for heating or cooling a space 102, suitable for use in accordance with an embodiment of the invention. The system 100 includes a thermostat/system controller 104, a blower motor 106 and optional associated filter 108, a heating and cooling source 110, an HVAC blower 112 and optional associated filter 114, and an airflow path 116. It will be appreciated that blower 112 and blower motor 106 may also be integrated into a single assembly (as discussed later), and thus the schematic of system 100 should be interpreted as only being illustrative in nature and not in any limiting sense.

Figure 2:
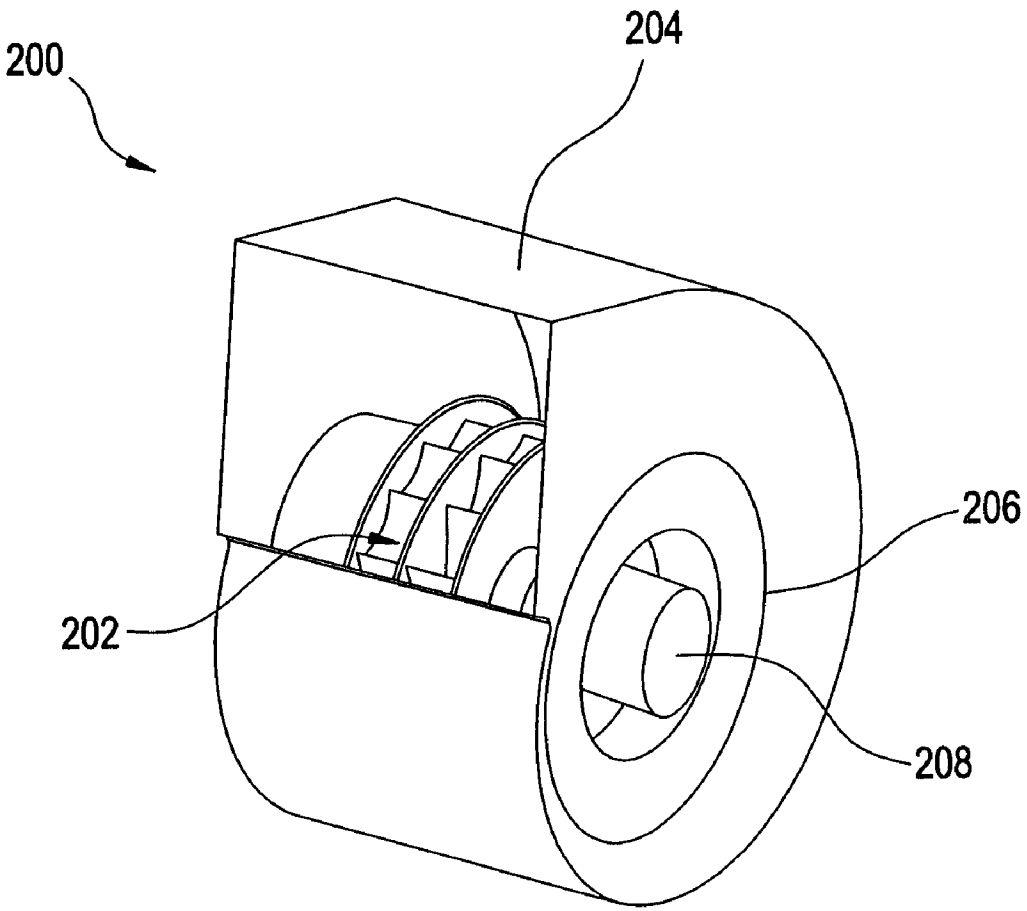
FIG. 2 is a perspective view of a novel blower assembly in accordance with an embodiment of the invention.
Figure 3:
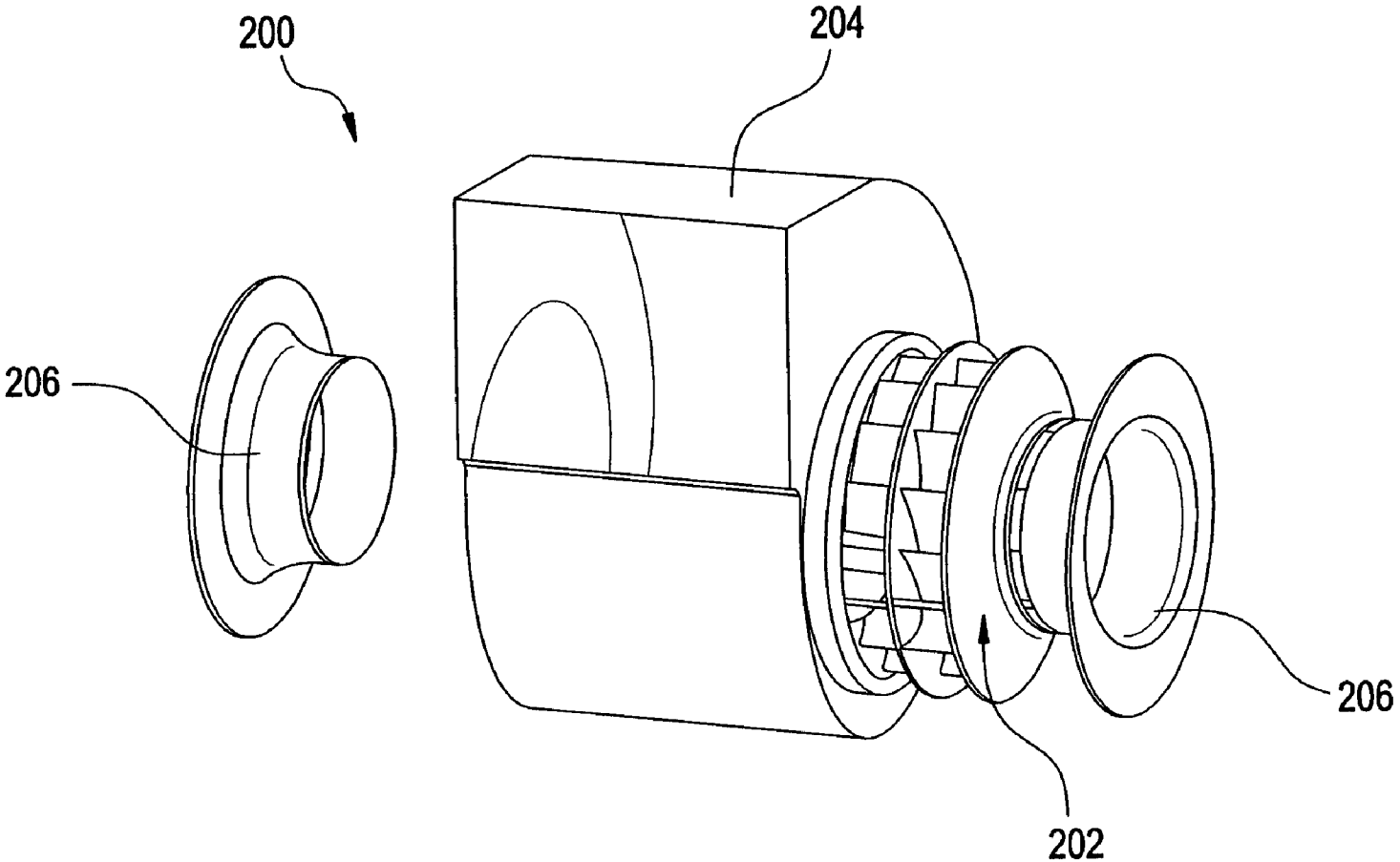
FIG. 3 is an exploded perspective view of the blower assembly shown in FIG. 2.

As stated previously, the HVAC blowers utilizing forward curved blades generally have lower efficiencies, while those blowers utilizing backward curved blades have higher efficiencies, but with generally less effective flow controllability. Therefore, in accordance with an embodiment of the invention, a novel blower assembly 200 featuring a blower wheel 202 having "S" shaped fan blades/impellers is depicted in FIGS. 2-3. As is illustrated, the blower wheel 202 (depicted in FIGS. 2-3 as a double wheel) is disposed within a logarithmic shaped housing 204 having a pair of inlet cones 206 on opposite sides thereof, as best seen in FIG. 3. In addition, an electronically commutated motor (ECM) 208 is operatively coupled to the blower wheel 202 through one of the inlet cones 206.

Figure 4:
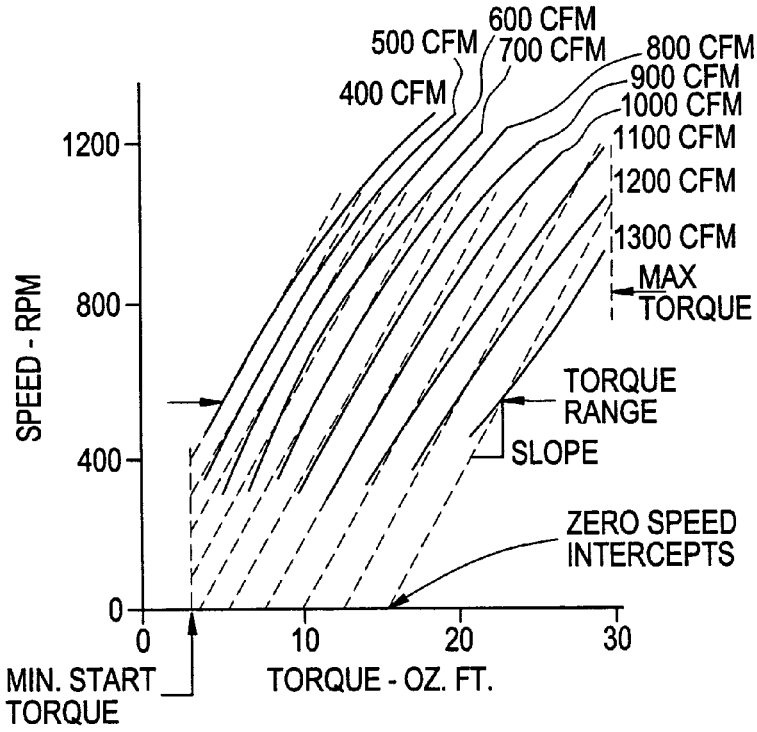
FIG. 4 is an exemplary series of speed versus torque curves used for airflow control in conjunction with an electronically commutated motor (ECM)

In a preferred embodiment, the ECM 208 is configured in a manner wherein the speed of the blower is set to effect a preselected flow rate at an existing static pressure in the contained space, and the speed of the blower is altered only in response to a variation in the static pressure and only in following relation with the static pressure variation. The speed alteration of the blower is sensed, and the speed of the blower is adjusted in following relation with the sensed speed alteration to establish the preselected flow rate through the contained space at the varied static pressure acting on the blower. FIG. 4 is an exemplary graphical representation of the cubic feet per minute (CFM) flowed at various static pressures when the blower assembly 200 is configured with an ECM 208. The CFM is a function of the speed and torque of the blower wheel 202. Each of the solid lines on the graph represent a constant CFM line, illustrating the near linear relationship between speed and torque and the variation in speed and torque as static pressure increases for any given CFM. Additional details regarding the operation of ECM 208 may be found in U.S. Pat. No. 4,806,833 to Young.

Figure 6:
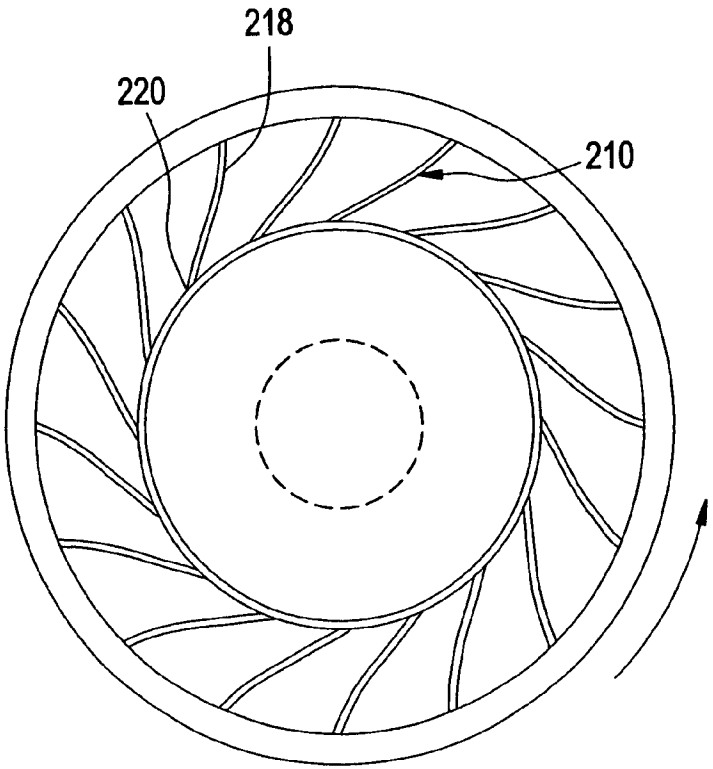
FIG. 6 is a sectional view of the blower wheel of FIG. 5.
Figure 5:
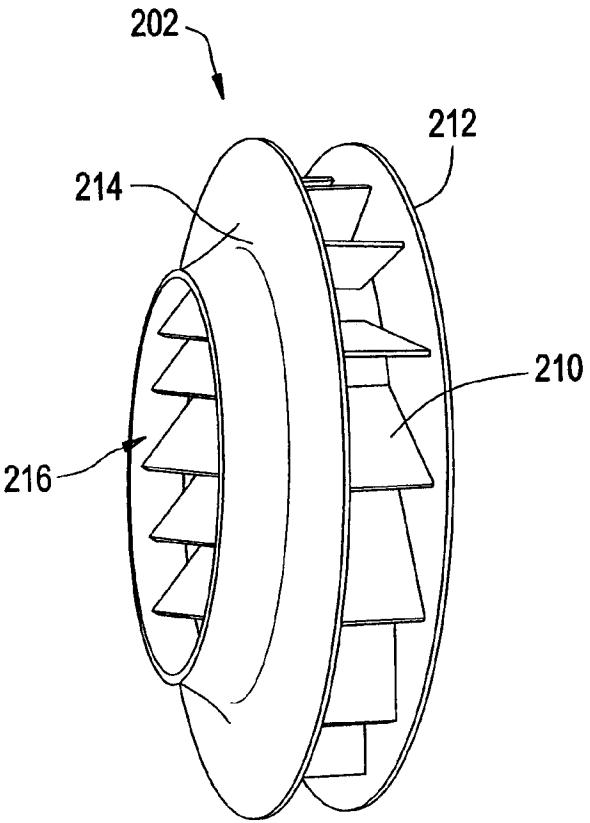
FIG. 5 is a perspective view of a blower wheel featuring S-shaped fan blades, in accordance with a further aspect of the invention.

Referring generally now to FIGS. 5-6, the blower wheel 202 (single configuration) is shown in further detail. As can be seen in FIG. 5, the individual blades 210 are mounted between a center disk 212 serving as a first blade support and a wheel cone 214 with a central air inlet 216 serving as a second blade support. As shown more particularly in FIG. 6, each of the blower blades 210 are formed so as to have a generally S-shaped configuration, wherein the trailing edge 218 of the blade 210 (the direction of rotation being counterclockwise in FIG. 6) is bent in a forward direction with respect to the rest of the blade. Moreover, it will be noted that in accordance with the S-shape configuration, the leading edge 220 of each blade 210 is inwardly curved with respect to the center of the wheel 202, whereas the trailing edge is outwardly curved. Thus configured, the blades 210 reduce or smooth out the flow separation characteristic of an ordinary forward curved blade, and accordingly, airflow controllability is retained to an acceptable extent.

In an exemplary embodiment, a total of sixteen blades were implemented in the blower wheel 202 following several CFD (computational flow dynamics) simulations illustrating how the airflow efficiency was affected by greater or fewer numbers of blades. However, depending upon the final application and the type of blade material used, the total number of blades may be in the range of about 12 to about 18. In addition, the leading and trailing edge angles of each blade 210 may be adjusted to adapt to different housing restrictions. The particular blade angles have also been adjusted to help keep efficiency high while gaining separation in the torque-speed characteristics for airflow controllability. The axial center disk location may be adjusted to offset the flow imbalance caused by the motor blockage of inlet air.

Figure 7:
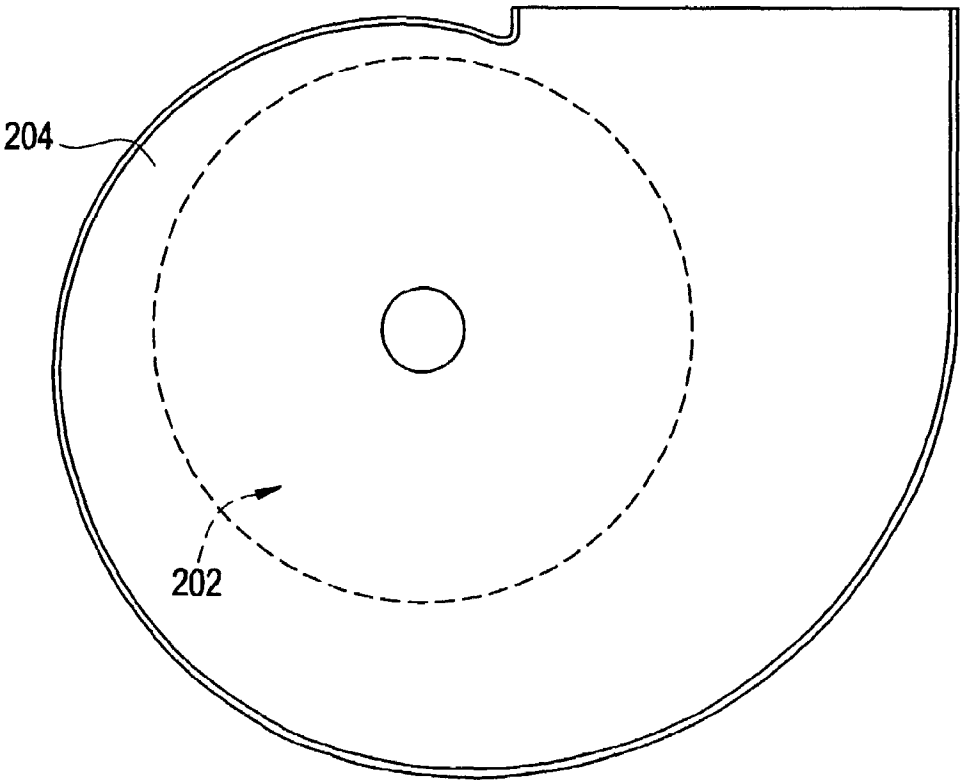
FIG. 7 is a sectional view of a blower housing in accordance with a further aspect of the invention.

The inclusion of a small radius electric motor 208 in an intake region of the dual inlet blower was selected in view of the outside diameter of the overall wheel 202, with the dimensions thereof being selected so as to help minimize the blower height dimensions while also maximizing the efficiency. As shown in FIG. 7, the logarithmic design of the housing 204 takes into account both efficiency and HVAC packaging space limitation concerns.

Figure 8:
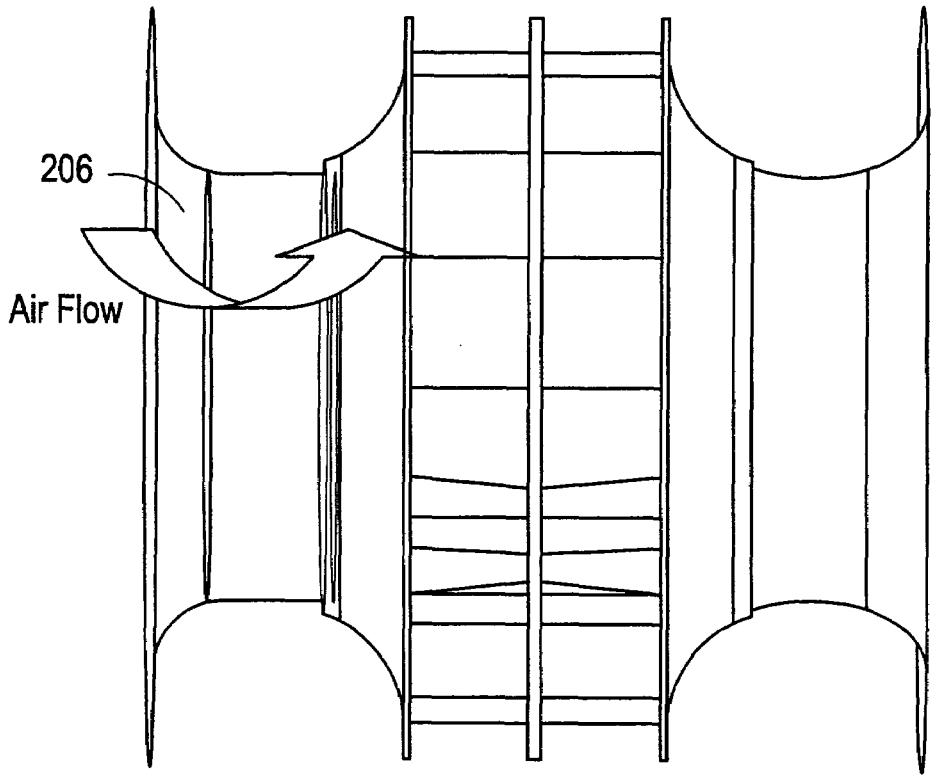
FIG. 8 is a sectional view of another embodiment of an inlet cone, in accordance with a further aspect of the invention.

FIG. 8 is a sectional view of another embodiment of the inlet cone 206. As can be seen, the diameter of the cone 206 initially decreases in a radially inward direction with respect to the blower wheel, but then increases in diameter. Stated another way, the diameter of the inlet cone 206 is at a minimum at about a midpoint thereof. This particular configuration facilitates the turning over of inlet air to reduce flow separation loss.

Figure 9:
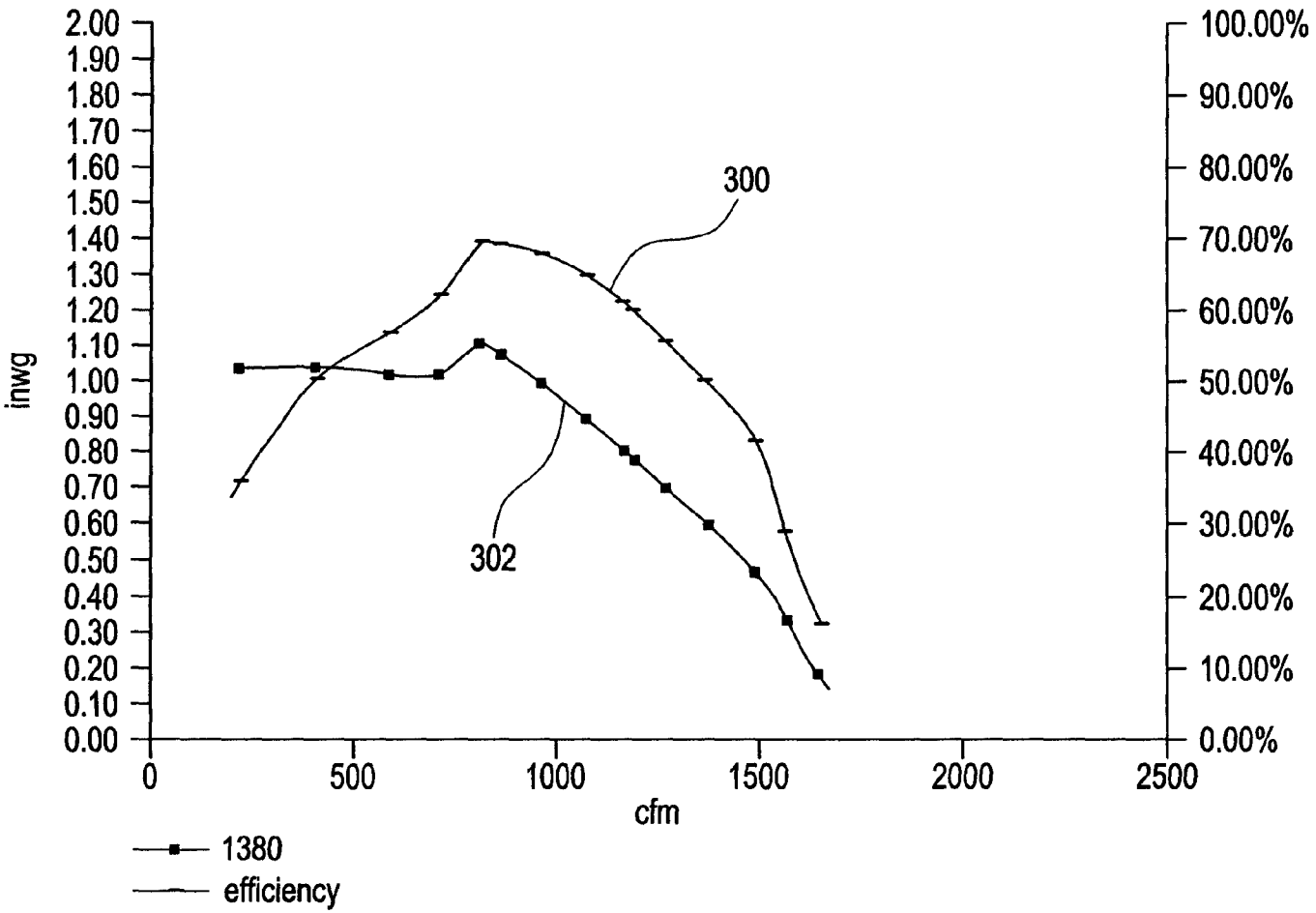
FIG. 9 is an exemplary fan curve illustrating efficiency and static pressure rise as a function of airflow for the blower assembly of FIG. 2.

FIG. 9 is an exemplary fan curve illustrating efficiency and static pressure rise as a function of airflow for the blower assembly 200. As can be seen from the efficiency curve 300, the static efficiency has reached a peak of about 70% at a flow rate of about 800 cubic feet per minute (CFM), which is about 15% higher than existing OEM blowers. In addition, the curve 302 illustrates the relationship between the flow rate and the pressure (in inches of water) against which the blower assembly 200 can discharge air, at a motor speed of about 1380 rpm.

Figure 10:
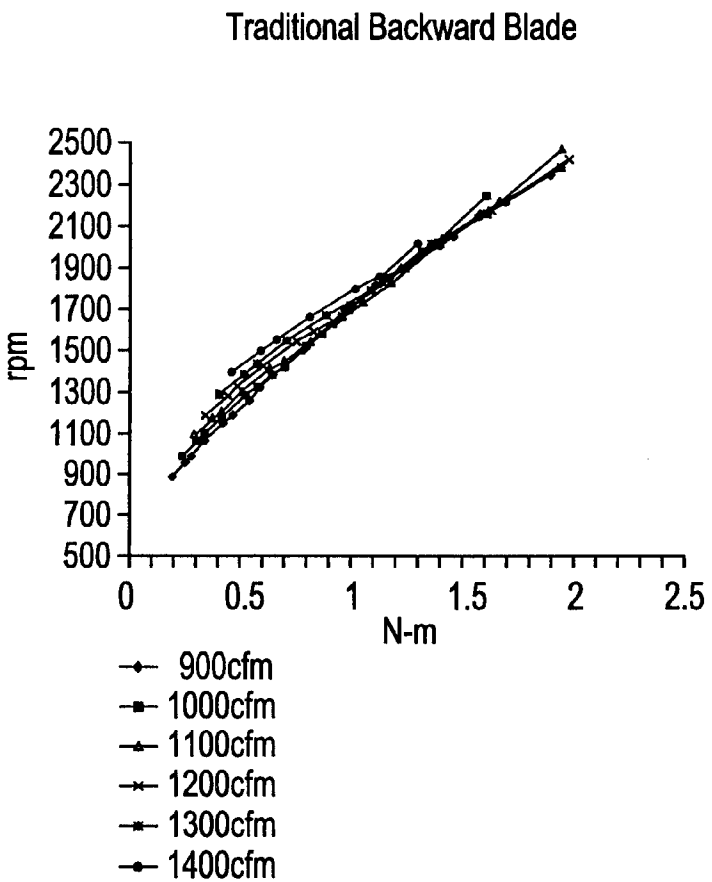
FIG. 10 PRIOR ART
FIGS. 10 and 11 are exemplary torque versus speed curves at different flow rates for a conventional backward curved blade, and for the S-shaped blade, respectively.
Figure 11:
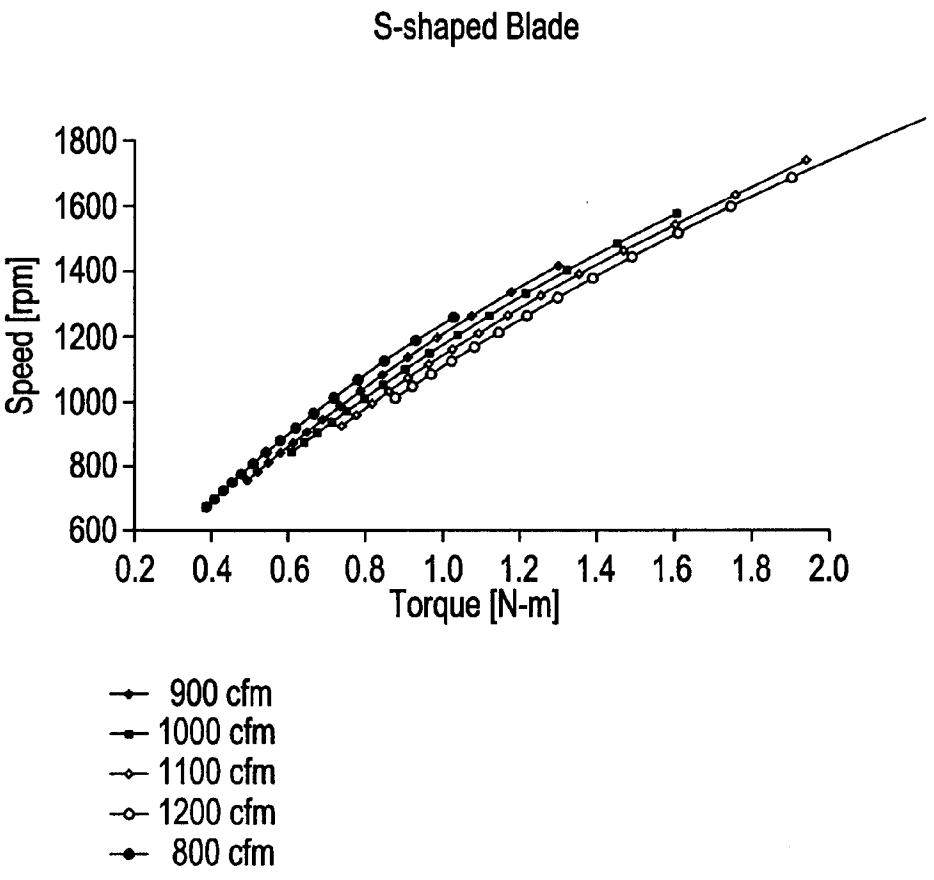

Finally, FIGS. 10 and 11 are exemplary torque versus speed curves at different flow rates for a conventional backward curved blade, and for the S-shaped blade, respectively. As stated earlier and illustrated in FIG. 10, the speed vs. torque curves (for various CFM values) of a conventional BC blower are overlapped with one other. This condition is unsuitable for easy determination of torque/speed/airflow parameters from one another. In contrast, FIG. 11 illustrates a series of torque/speed curves for various flow rates. It will be noted that the curves have a well-defined separation therebetween, which is thus indicative of good flow controllability.

As will be appreciated from the foregoing description, the novel blower assembly and corresponding "S" shaped blades enhance blower efficiency and retain flow controllability, while also utilizing a special logarithmic housing design that can be adapted to different OEM HVAC units and help retain the flow controllability. The number of blades (e.g., from about 12 to about 18) and the overall dimensions of the blower wheel are particularly suited for integration into present HVAC systems that are space-limited. Moreover, the integration with variable speed, ECM technology also provides superior output airflow controllability through the unique mapping of torque-speed with airflow and static pressure. An electronically commuted motor, such as that available from General Electric has about a 2:1 efficiency advantage over a single-speed induction motor.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A centrifugal blower wheel for a heating, ventilation and air conditioning (HVAC) blower unit, comprising:
- a first blade support;
- a second blade support offset from said first blade support by a distance along a central axis of rotation; and
- a plurality of S-shaped blades extending between and coupled to said first and said second blade supports, wherein each of said S-shaped blades has a trailing edge bent in a forward direction with respect to a defined direction of rotation of the wheel, and the blade supports extend beyond the trailing edge of the S-shaped blade.

2. The blower wheel of claim 1, wherein a leading edge of said S-shaped blades is inwardly curved with respect to the center of the wheel.

3. The blower wheel of claim 2, wherein said trailing edge is outwardly curved with respect to the center of the wheel.

4. The blower wheel of claim 1, wherein said plurality of S-shaped blades comprises about 12 to about 18 individual blades.

5. The blower wheel of claim 1, wherein said plurality of S-shaped blades comprises 16 individual blades.

6. An integrated heating, ventilation and air conditioning (HVAC) blower apparatus, comprising:
- a centrifugal blower wheel disposed within a housing;
- an electronically commutated motor (ECM) in operative communication with said centrifugal blower wheel, said ECM extending at least partially through a first inlet cone disposed in a first side of said housing; and
- said centrifugal blower wheel further comprising:
  - a first blade support;
  - a second blade support; and
  - a plurality of S-shaped blades extending between and coupled to said first and said second blade supports, wherein each of said S-shaped blades has a trailing edge bent in a forward direction with respect to a defined direction of rotation of said wheel, and the blade supports extend beyond the trailing edge of the S-shaped blade.

7. The HVAC blower apparatus of claim 6, wherein a leading edge of said S-shaped blades is inwardly curved with respect to the center of the wheel.

8. The HVAC blower apparatus of claim 7, wherein said trailing edge is outwardly curved with respect to the center of the wheel.

9. The HVAC blower apparatus of claim 6, wherein said plurality of S-shaped blades comprises about 12 to about 18 individual blades.

10. The HVAC blower apparatus of claim 6, wherein said plurality of S-shaped blades comprises 16 individual blades.

11. The HVAC blower apparatus of claim 6, wherein said inlet cone has a central axis, an axial length, and a diameter that generally decreases from opposite ends of the axial length toward an intermediate region along the axial length.

12. A heating, ventilation and air conditioning (HVAC) system for heating/cooling a space, comprising:
- a system controller;
- at least one of a heating and a cooling source;
- an integrated blower apparatus in communication with said system controller; and
- an airflow path for circulating air through the space;
- said integrated blower apparatus further comprising:
  - a centrifugal blower wheel disposed within a housing, said centrifugal blower wheel further including a first blade support, a second blade support offset from said first blade support by a distance along a central axis of rotation, and a plurality of S-shaped blades extending between and coupled to said first and said second blade supports, wherein each of said S-shaped blades has a trailing edge bent in a forward direction with respect to a defined direction of rotation of said wheel, and the blade supports extend beyond the trailing edge of the S-shaped blade; and
  - an electronically commutated motor (ECM) in operative communication with said centrifugal blower wheel, said ECM extending at least partially through a first inlet cone disposed in a first side of said housing.

13. The HVAC blower system of claim 12, wherein a leading edge of said S-shaped blades is inwardly curved with respect to the center of the wheel.

14. The HVAC blower system of claim 13, wherein said trailing edge is outwardly curved with respect to the center of the wheel.

15. The HVAC blower system of claim 12, wherein said plurality of S-shaped blades comprises about 12 to about 18 individual blades.

16. The HVAC blower system of claim 12, wherein said plurality of S-shaped blades comprises 16 individual blades.

17. The HVAC blower system of claim 12, wherein said inlet cone has a central axis, an axial length, and a diameter that generally decreases from opposite ends of the axial length toward an intermediate region along the axial length.

18. The HVAC blower apparatus of claim 6, wherein the first and second blade supports are offset by a distance along a central axis of rotation.

19. A system, comprising:
- a heating ventilation and air conditioning (HVAC) blower, comprising:
  - a first blade support;
  - a second blade support offset from the first blade support by a distance along a central axis of rotation; and
  - a plurality of S-shaped blades extending between and coupled to the first and second blade supports, wherein each of the S-shaped blades has a trailing edge bent in a forward direction with respect to a defined direction of rotation, and the trailing edge is generally free from the first and second blade supports.

* * * * *